US005963149A

United States Patent [19]

Nagura et al.

[11] Patent Number: 5,963,149

[45] Date of Patent: Oct. 5, 1999

[54] MOVABLE BODY COMMUNICATION SYSTEM

[75] Inventors: Michinaga Nagura, Kariya; Ichiro Yoshida, Takahama; Rokuro Okada, Kariya, all of Japan

[73] Assignee: Nippondenso Co., Ltd., Kariya, Japan

[21] Appl. No.: 08/639,525

[22] Filed: May 1, 1996

[30] Foreign Application Priority Data

May 2, 1995 [JP] Japan ..... 7-108421

[51] Int. Cl.[6] ..... G08G 1/01

[52] U.S. Cl. ..... 340/933; 340/928; 340/825.31; 342/42; 235/384

[58] Field of Search ..... 340/928, 932.2, 340/933, 991, 825.31; 342/51, 42, 44; 235/384, 380, 379

[56] References Cited

U.S. PATENT DOCUMENTS

| | | | |
|---|---|---|---|
| 4,303,904 | 12/1981 | Chasck | 340/933 |
| 4,325,146 | 4/1982 | Lennington | 340/636 |
| 4,338,587 | 7/1982 | Chiappetti | 340/933 |
| 5,202,550 | 4/1993 | Kocznar et al. | 235/382 |
| 5,204,675 | 4/1993 | Sekine | 340/933 |
| 5,253,162 | 10/1993 | Hassett et al. | 340/405 |
| 5,337,066 | 8/1994 | Hirata et al. . | |
| 5,424,727 | 6/1995 | Shieh | 340/928 |
| 5,581,249 | 12/1996 | Yoshida | 340/928 |
| 5,640,156 | 6/1997 | Okuda et al. | 340/928 |
| 5,648,767 | 7/1997 | O'Connor et al. | 340/928 |
| 5,710,556 | 1/1998 | Nishimura et al. | 340/928 |
| 5,710,566 | 1/1998 | Grabow et al. | 342/457 |

FOREIGN PATENT DOCUMENTS

| | | |
|---|---|---|
| 0 616 302 | 9/1994 | European Pat. Off. . |
| 64-79680 | 3/1989 | Japan . |
| 2-75989 | 3/1990 | Japan . |
| 4-315284 | 11/1992 | Japan . |
| 6-236497 | 8/1994 | Japan . |

*Primary Examiner*—Nina Tong
*Attorney, Agent, or Firm*—Pillsbury Madison & Sutro LLP

[57] ABSTRACT

A response unit located on a vehicle performs transmission operations for transmitting signals including a pilot response signal responsive to receipt of a pilot signal from a fixed transceiver. The transceiver uses a highly directive transmission antenna to transmit a beam-shaped signal containing a pilot signal to a communication zone set with respect to a lane along which the vehicle travels. The fixed transceiver also performs data transmission/reception operations with the response unit when it receives a pilot response signal therefrom. The beam-shaped signal is set to have a radiation area smaller than the area of the communication zone and is electronically scanned within the communication zone in a direction orthogonal to the movement direction of the vehicle by a scanner in the transceiver. The scan patterns of beams from transceivers corresponding to adjacent lanes are synchronized so that the scan areas of signals from adjacent transmission antennas do not overlap.

27 Claims, 9 Drawing Sheets

MOVABLE BODY COMMUNICATION SYSTEM

CROSS-REFERENCE TO RELATED APPLICATIONS

The present application is related to and claims priority from Japanese Patent Application No. Hei 7-108421, incorporated herein by reference.

BACKGROUND OF THE INVENTION

1. Field of the Invention

The present invention relates to a movable body communication system which, when a movable body is located in a preset communication zone, performs transmission and reception operations between a response unit located on the movable body and a transceiver corresponding to the communication zone.

2. Description of Related Art

The above-described type of movable body communication system has been used in, for example, an automatic toll collection system for a turnpike. FIG. 12 schematically illustrates such an automatic toll collection system.

That is, in FIG. 12, a response unit 3 is located on a vehicle 2 going through a turnpike 1 having a plurality of lanes 1*a*. The response unit 3 performs transmission operations for transmitting radio signals including a response signal when it receives a pilot signal. Also, a number of transceivers 5 are located on an overpass 4 spanning the turnpike 1 in one-to-one correspondence with the lanes 1*a*. Each of these transceivers 5 performs a transmission operation for transmitting a pilot signal with respect to a respective communication zone 1*b* set at a lane 1*a* and, when it receives a response signal from the response unit 3, performs data transmission and reception for toll collection between itself and the response unit 3. Note that as illustrated in FIG. 13, when the width of the lane 1*a* is, e.g., three to four meters, the communication zone 1*b* is set so that the diameter thereof as viewed in the horizontal and vertical directions is three to five meters.

However, since the movable body communication system covers each communication zone 1*b* with a single corresponding transceiver 5, when as illustrated in FIG. 14, two vehicles 6*a* and 6*b* (in this case, motorcycles) enter the same communication zone 1*b* in parallel with each other, radio interference occurs between the response units 3 located on the vehicles 6*a* and 6*b* and the transceiver 5.

Also, although FIG. 14 illustrates a case where both vehicles 6*a* and 6*b* have response units 3 located thereon. When one vehicle 6*b* is a rogue vehicle having no response unit 3 located thereon, it is impossible to discriminate this rogue vehicle. Specifically, in this case, when collection of a traffic charge in correspondence with communication with the qualified vehicle 6*a* has been performed, it is impossible for the transceiver 5 to accurately detect which of the vehicles 6*a* and 6*b* it has communicated with; therefore, there is a serious problem that the automatic toll collection system per se ceases to perform its normal function.

Further, since it is inevitable that an overlapped portion as illustrated in FIG. 12 occurs between adjacent two of the communication zones 1*b*, and there is the inconvenience that signals from two adjacent transceivers 5 interfere with each other in the overlapped portion. To counteract this, it is necessary to perform time-division multiplexed communication between adjacent transceivers 5 or to differentiate the frequency bands used therebetween. Thus, communication performance decreases, or it is necessary to provide multiple antennas having differing resonant frequencies, resulting in an overall increase in system complexity.

SUMMARY OF THE INVENTION

In view of the above-described problems of the prior art, it is an object of the present invention to provide a movable body communication system where, even when a plurality of movable bodies exist in the same communication zone, there is no possibility that radio interference occurs, and it is consequently possible to reliably discriminate a movable body with which communications have been performed. It is a further object of the present invention to provide a movable body communication system which, even when a plurality of communication zones are provided adjacent to one another, enhances the communication performance thereof and simplifies the overall system structure.

The above object is achieved in a preferred embodiment of the present invention by providing a movable body communication system which includes fixed transceivers transmitting communication signals to communication areas in respective road lanes, and multiple response units disposed on moving vehicles. Rather than transmitting a signal which covers a large communication area in the lane, each transceiver uses a scanner to move a small, highly directional signal across its lane in a direction perpendicular to the path of vehicle travel.

Since the area covered at any particular moment in time is small, there is little possibility that two vehicles will occupy the active communication area at the same time and simultaneously respond to a signal from the transceiver. Thus, the reliability of the system is increased. Further, by synchronizing the scan patterns of adjacent transceivers so that they do not overlap one another, interference between adjacent transceivers can be avoided.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

A preferred embodiment of the present invention used as an automatic traffic-toll collection system for use in a road will now be explained with reference to FIGS. 1 through 11C.

Figure 2:
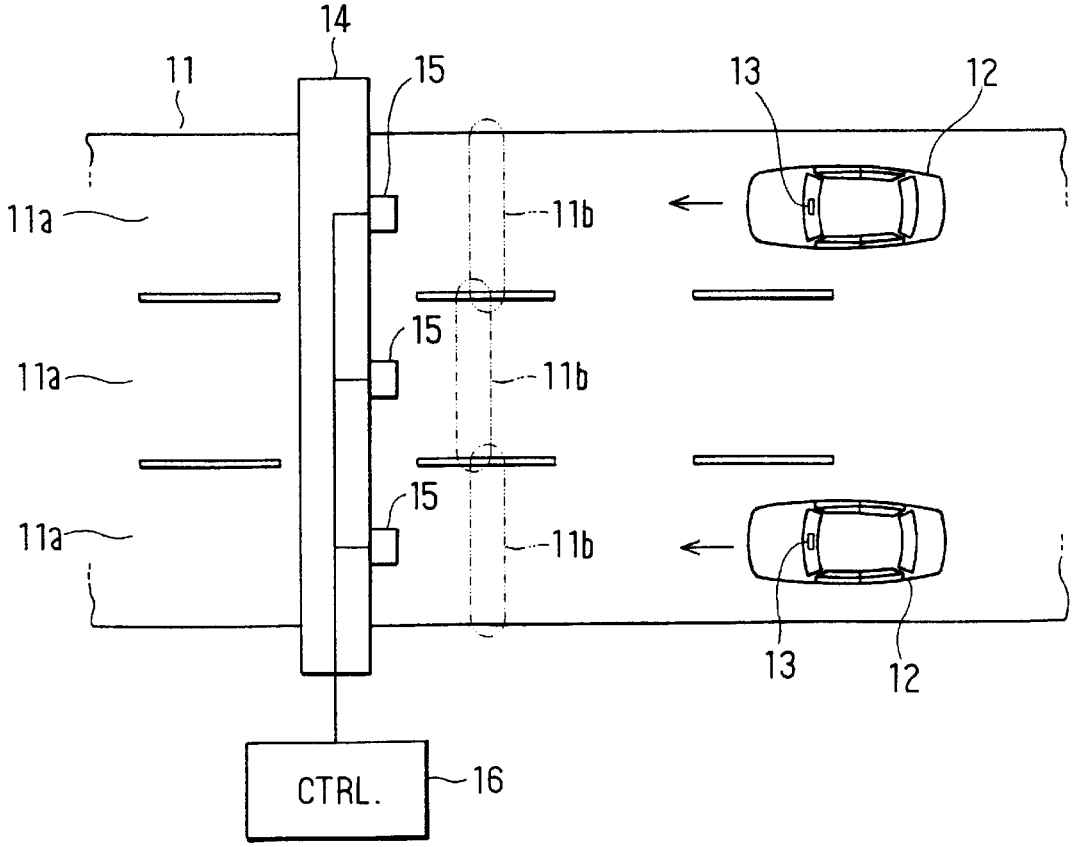
FIG. 2 is an overhead view of an automatic toll collection system for a road according to the embodiment.

FIG. 2 shows an automatic toll collection system according to this embodiment. In FIG. 2, a response unit 13 is located on a vehicle 12 which is moving along a road 11 in an direction indicated by an arrow in the Figure. The road 11 has lanes 11*a* constituting multiple travel paths. Each time the response unit 13 receives a pilot signal and an interrogation signal to be described in greater detail below, it transmits signals including a pilot response signal and an interrogation signal, each of which contains an ID code.

Three transceivers 15 in one-to-one correspondence with the lanes 11*a* are on an overpass 14 spanning the road 11. These transceivers 15 are controlled by a control unit 16. Each of the transceivers 15 repeatedly transmits a pilot signal to a corresponding communication zone 11*b* and, upon receiving a pilot response signal from the response unit 13, thereafter transmits an interrogation signal, such as a readout signal or write-in signal for performing toll collection processing, to the response unit 13 and receives an interrogation response signal or the like from the response unit 13.

In this case, the response unit 13 does not output a self-generated pilot response signal or interrogation response signal, but instead outputs the response signal by utilizing the signal from the transceiver 15. That is, the transceiver 15 outputs an unmodulated carrier wave (hereinafter referred to as a carrier signal) after it has transmitted the pilot signal or interrogation signal. Upon receipt of the carrier signal, the response unit 13 wakes up and, by modulating the carrier signal and reflecting the resulting modulated signal, transmits the pilot response signal or the interrogation response signal. As a result, it is not necessary to provide an oscillator, power source and the like for generating signals in the response unit 13, thereby promoting miniaturization and structural simplification of the response unit 13.

Figure 1:
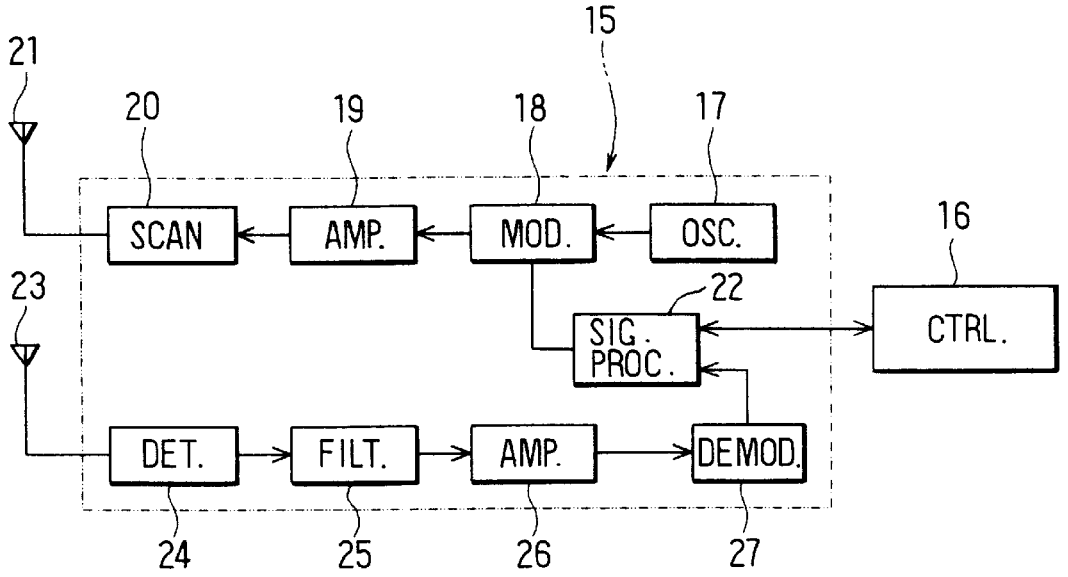
FIG. 1 is a functional block diagram of a transceiver according to a preferred embodiment of the present invention.

FIG. 1 is a block diagram of the transceiver 15 where, in the transceiver 15, the output of an oscillator 17 is set to a prescribed frequency in a millimetric band (e.g., 60 GHz or so) and, after passing through a modulator 18, amplifier 19 and a scanner 20 (corresponding to the scanning means recited in the appended claims), the oscillation signal therefrom is transmitted from a transmission antenna 21 as a millimetric carrier signal.

It should be noted that as used herein and in the appended claims, the terms "millimetric band" and "millimetric waves" cover waves in the frequency range of 30 GHz to 300 GHz, and that "microwave band" and "microwaves" cover waves in the frequency range of 1 GHz to 30 GHz.

The modulator 18 modulates the output of the oscillator 17 based on transmission data supplied from the control unit 16 via a signal processing circuit 22, and the resulting modulated signal is transmitted from the transmission antenna 21 as the above-described pilot signal or interrogation signal. In this case, as described above, the transceiver 15 repeatedly transmits the pilot signal in prescribed cyclic periods and, upon receiving a pilot response signal from the response unit 13, transmits a prescribed interrogation signal. Also, after transmitting the pilot signal or interrogation signal, the transceiver 15 outputs an unmodulated carrier signal to be modulated and reflected by the response unit 13.

The transmission antenna 21 uses, for example, a microstrip-type patch antenna wherein a patch composed of a thin film conductor is disposed on a dielectric substrate. It is constructed as an array antenna having multiple patch antennas in a directional array to enhance the directionality of the antenna, enable long-distance communication and emit a scan-shaped radiation beam. In this case, a beam-shaped (e.g., a beam having a circular or elliptical cross section whose diameter is from 30 to 50 cm or so) signal whose radiation area is set to be smaller than the area of the communication zone 11*b* is radiated from the transmission antenna 21.

The scanner 20 includes a digital phase shifter known in the art as a phased array antenna. By electronically varying the phase of an electric signal supplied to the transmission antenna 21, it scans a beam-shaped signal radiated from this transmission antenna 21 in prescribed cyclic periods.

Figure 3:
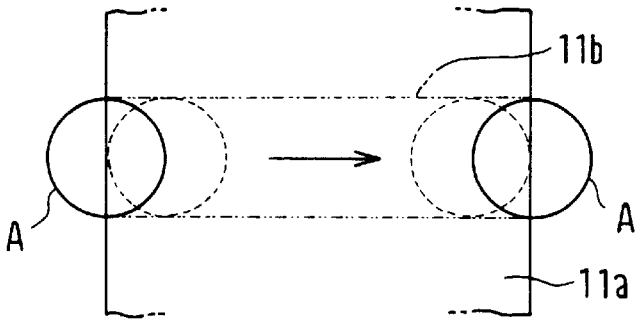
FIG. 3 shows a scan range of signals from the transceiver in the embodiment.

Specifically, the scanner 20 scans a beam-shaped signal radiated from the transmission antenna 21 in a direction orthogonal to the direction of travel of the vehicle 12 within the communication zone 11*b*. As a result, as illustrated in FIG. 3, a radiation zone A of the signal is sequentially displaced in one direction (e.g., in a direction indicated by the arrow in the Figure) between the ends of the communication zone 11*b* set with respect to the lane 11*a*.

Figure 5:
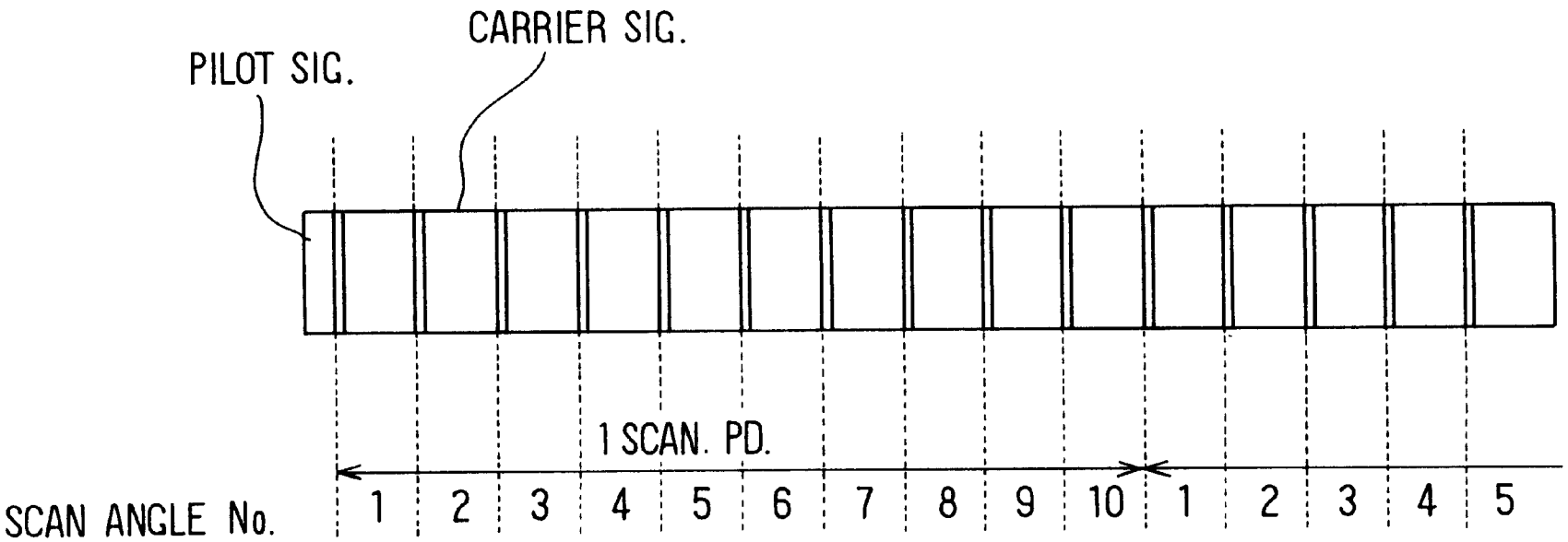
FIG. 5 shows the output timing at which a pilot signal is output from the transceiver in the embodiment.

FIG. 5 shows an example of a pilot signal output timing when the communication zone 11*b* is scanned by the transmission antenna 21 as described above. Note that for simplicity, FIG. 5 shows an example where a pilot signal is transmitted a total of ten times (i.e., the timings which correspond to times when the scan angle number is 1, 2, . . . 10) during one scanning period, the maximum value of the scan angle number actually is set to be 50 to 100 or so.

Also, in this case, the scan patterns of the scanners 20 included in the respective transceivers 15 are synchronized with each other so that one scan area corresponding to one transmission antenna 21 does not overlap a scan area covered by a signal radiated from an adjacent transmission antenna 21.

Figure 4:
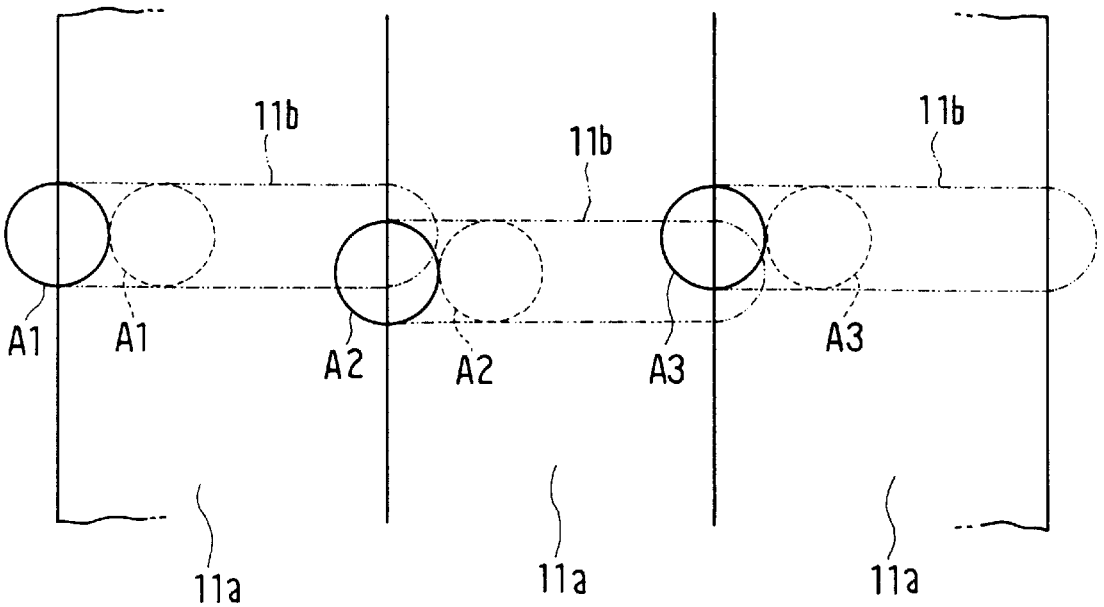
FIG. 4 shows another scan range of signals from the transceiver in the embodiment.

That is, as illustrated in FIG. 4, in the cyclic periods, when scans are started, respective radiation zones A1, A2 and A3 of the signals from the three transmission antennas 21 shown in the Figure are located at, for example, their leftmost positions of the corresponding communication zones 11*b* as indicated by the solid lines in the Figure. When a prescribed time period has lapsed after the commencement of the scanning operations, they are located at positions displaced by a prescribed distance to the right of the previous positions in the communication zones 11*b* as shown by the dotted lines in the Figure. As a result of this, the scan areas covered by adjacent transmission antennas 21 do not overlap each other at the same time.

Note that although the scanning operations in this case are performed in one direction, it is also possible to construct the transceiver so that a reciprocating scanning operation is performed. Also, the above-described scanning cyclic period is set to a cyclic period which, even when the vehicle 12 is traveling at a speed of 200 km per hour or more, makes it possible to ensure a time period necessary for performance of communications between the response unit 13 located on the vehicle 12 and the transceiver 15.

Returning to FIG. 1, a reception antenna 23 receives pilot response signals and interrogation response signals reflected from the response unit 13. The received signals are supplied to the signal processing circuit 22 via a detector 24, filter 25, amplifier 26 and demodulator 27. In correspondence with the communication with the response unit 13 which is made based on the interrogation signal resulting from the operation of the control unit 16, the signal processing circuit 22 discriminates an identification code specific to the response unit 13 for processing of toll collection data or balance data corresponding to the use of a relevant road, and finally transfers the results of this processing to the control unit 16.

Next, the operation and effect of the above-described system will be explained.

The transmission antenna 21 included in the transceiver 15 repeatedly transmits a beam-shaped signal containing a pilot signal component to the communication zone 11*b* set with respect to the road 11 at a prescribed cyclic timing while the scanner 20 electronically scans a signal radiated from the transmission antenna 21 within the communication zone 11*b* in a direction orthogonal to the direction of travel of the vehicle 12.

Consequently, when the vehicle 12 having the response unit 13 located thereon has entered the communication zone 11*b*, the response unit 13 falls within the above-described scan area and, in correspondence therewith, the response unit 13 receives a pilot signal contained in the signal radiated from the transmission antenna 21. Then, since the response unit 13 transmits a pilot response signal, the transceiver 15, upon receiving this pilot response signal, performs data communication based on the use of interrogation signals and interrogation response signals with the response unit 13 which transmitted the pilot response signal.

Figure 6:
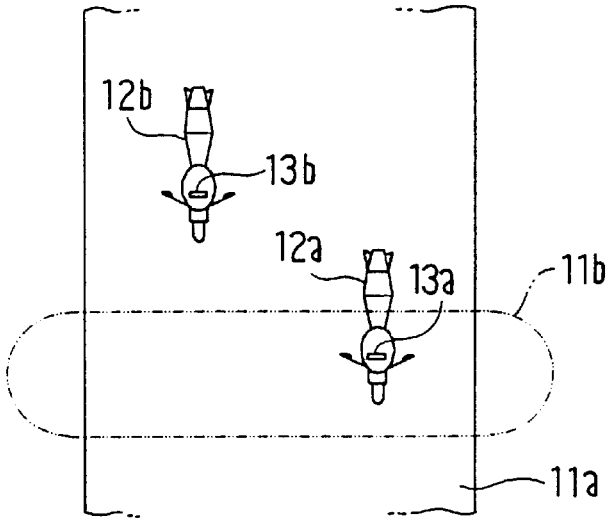
FIG. 6 is an overhead view showing operation of the movable body communication system according to the embodiment.

In this case, since the radiation area of a beam-shaped signal to be scanned within the communication zone 11*b* is set to be smaller than the area of this communication zone 11*b*, the possibility that two or more response units 13 may exist in the radiation portion of the communication zone 11*b* at the same point in time is small. As a result, as shown in FIG. 6, even when two vehicles 12*a* and 12*b* (here, two-wheelers) enter the same communication zone 11*b* in tandem, the communication operations between the response units 13*a* and 13*b* respectively located on these two vehicles 12*a* and 12*b* and the transceiver 15 are performed with a prescribed time difference. Therefore, even when a plurality of the vehicles 12*a* and 12*b* exist in the same communication zone 11*b*, the possibility that radio interference may occur is greatly reduced.

With this arrangement, it is possible to implement two different type of communication protocols with multiple vehicles in the same communication zone 11*b*. In the first technique, hereinafter called "serial" processing, toll collection communications are exclusively conducted with one of the vehicles, and when those communications are completed, toll collection communications with the other vehicle are conducted. In the second technique, hereinafter called "parallel" processing, toll collection communications are performed with both vehicles in a time-division multiplexed access (TDMA) system.

Figure 7:
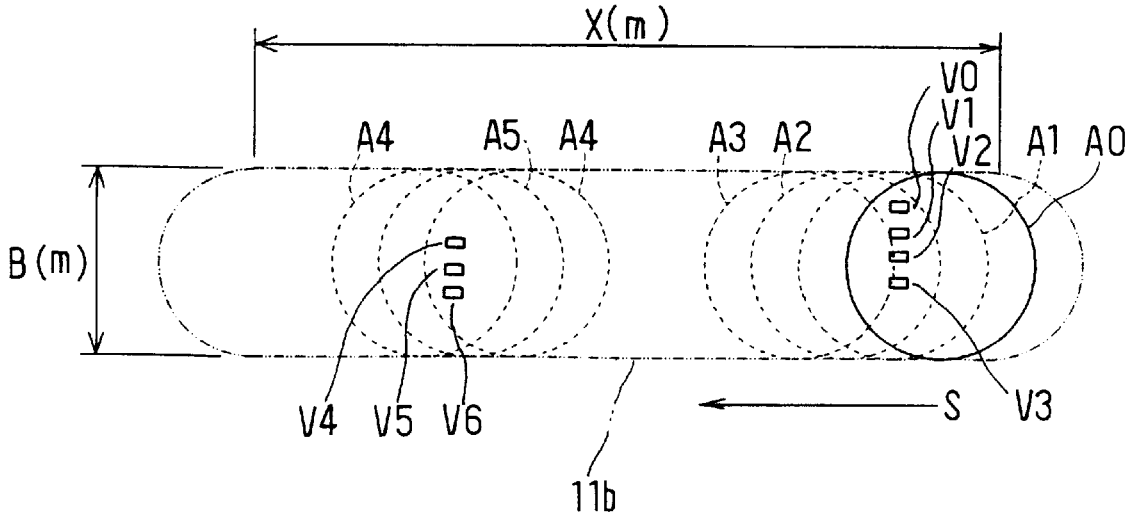
FIG. 7 shows an example of the communication sequence of the system according to the embodiment.

FIG. 7 shows an example of the relationship between the positions of the vehicles 12*a* and 12*b* and the radiation zones of a signal output from the transmission antenna 21 in the serial processing system which holds true when the two vehicles 12*a* and 12*b* (actually, the response units 13*a* and 13*b*) have entered the communication zone 11*b*. In this Figure, V0 to V3 indicate the positions of the response unit 13*a* at times t0 to t3, V4 to V6 indicate the positions of the response units 13*b* at times t4 to t6, and A0 to A6 indicate the radiation zones of a signal at the times t0 to t6 (provided, however, that the direction in which a beam-shaped signal is scanned with respect to the communication zone 11*b* is one direction indicated by an arrow S and t0<t1<t2<t3<t4<t5<t6). Also, the symbol B in FIG. 7 represents the width of the communication zone 11*b* and the symbol X represents the road width which is covered by the communication zone 11*b*, i.e., its length.

Figures 8A, 8B, 8C:
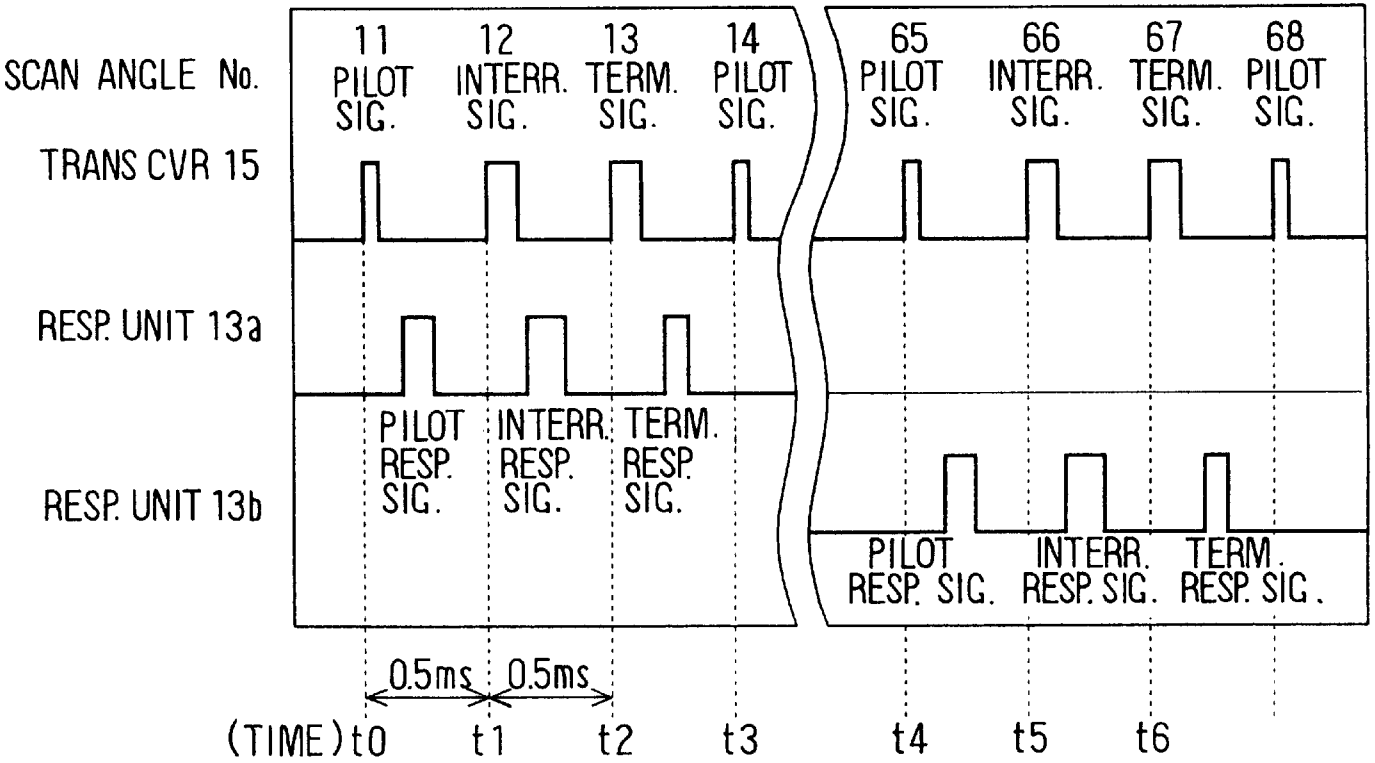
FIGS. 8A–8C are timing charts showing the content of the communication sequence in the embodiment.

FIGS. 8A–8C show transmission/reception sequences between the transceiver 15 and the response units 13*a* and 13*b* in a serial processing system as described above. Here, the intervals at which pilot signals are output from the transceiver 15 are each set to be, for example, 0.5 msec., and the maximum value of the scan angle number is set to be, for example, 100 or so.

As shown in FIG. 8B, the response unit 13*a* of the vehicle 12*a* first receives a pilot signal at a time t0 and returns a pilot response signal. Upon receiving this pilot response signal, the transceiver 15 transmits an interrogation signal such as a readout signal or write-in signal for performing toll collection processing at a time t1 thereafter.

Upon receiving this interrogation signal, the response unit 13*a* transmits an interrogation response signal. Upon receiving this interrogation response signal, the transceiver 15 transmits a termination signal for terminating the communication operation at a time t2 thereafter. Upon receiving this termination signal, the response unit 13*a* transmits a termination response signal. Upon receiving this termination response signal, the transceiver 15 completes its communications with the response unit 13*a* and at a time t3 thereafter again starts a transmission operation for transmitting a pilot signal.

Thereafter, when a time t4 is reached, the response unit 13*b* of the vehicle 12*b* receives the pilot signal, whereby communication operations between this response unit 13*b* and the transceiver 15 are performed in accordance with the same sequence as described above as shown in FIG. 8C.

In this case, the cyclic period in which the communication zone 11*b* is scanned by the beam-shaped signal can be determined using the following technique.

Assuming that the travel speed of the vehicle, the size of the communication zone and the retry (redundancy) frequency are represented by V, B and M, respectively, the time period T1 needed until the communication between the response unit 13 located on this vehicle and the corresponding transceiver 15 is completed is obtained using Equation 1.

$$T1=B/(v\cdot M) \tag{1}$$

Accordingly, if the relationship of T1<(t2−t0) is satisfied, it is possible to complete the communication between one of the response units 13*a* and 13*b* and the transceiver 15.

Assuming that the road width covered by the communication zone 11*b* is represented by X, in the case of one-way scanning of the communication zone 11*b* by the beam-shaped signal, the speed of this scanning (the movement speed of the signal radiation zone) Vs is obtained using Equation 2.

$$Vs=B/T1=v\cdot M \quad (2)$$

The time period ts needed for the signal radiation zone to cross the road one time is obtained using Equation 3.

$$ts=X/Vs=X/(v\cdot m) \quad (3)$$

Now, assuming that the size of the communication zone is 0.5 m, the speed of the vehicle is 200 km/hr=200,000/3600≈55.6 m/s, the retry frequency M is 3 and the road width is 4 m, then the required communication time period T1 is 3 ms, the scan speed Vs is 166.7 m/s and the time period ts needed for the signal radiation zone to cross the road one time is 24 ms.

Accordingly, if the intervals at which pilot signals in FIG. 8A are output from the transceiver 15 are each set to be 0.5 ms, it is possible to provide a communication system such as that shown in this embodiment by using the above-described values. In this case, if a signal in a millimetric band is used for the communications between the transceiver 15 and the response units 13*a* and 13*b*, since the data transmission capacity can be as high as 10 Mbps, the amount D of data which can be transmitted during a time period of 0.5 msec. is $10\times10^6\times0.5\times10^{-3}$=5000 bits=625 bytes.

Figure 9:
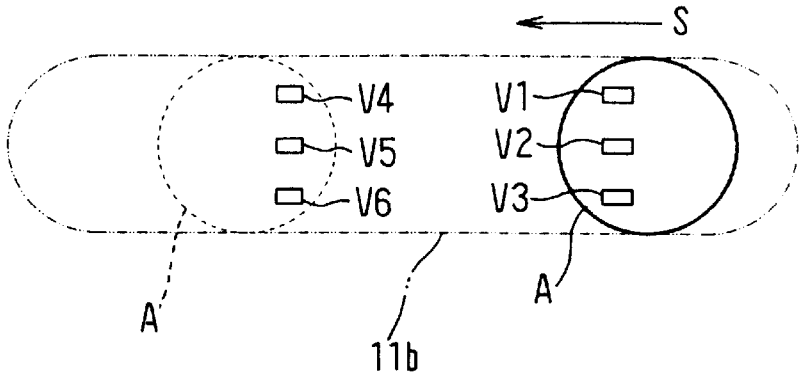
FIG. 9 shows another example of the communication sequence of the system according to the embodiment.
Figure 12:
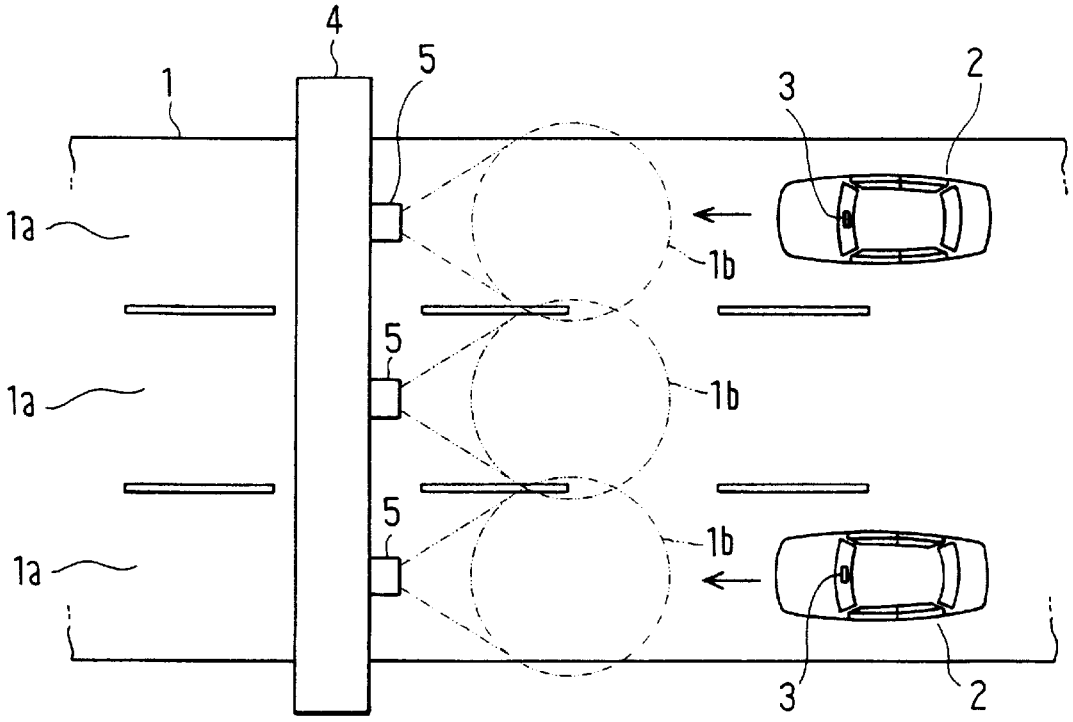
FIG. 12 PRIOR ART
FIG. 12 is an overhead view of an automatic toll collection system for a road according to the prior art.

Next, the communication sequence according to the parallel processing system wherein communication operations are executed between the transceiver and the vehicles existing in the communication zone alternately on a step-by-step basis will be explained. FIG. 9 shows an example of the relationship between the positions of the vehicles 12*a* and 12*b* and the signal radiation zone of the transmission antenna 21 which holds true when the two vehicles 12*a* and 12*b* (actually, the response units 13*a* and 13*b*) have entered the communication zone 11*b*. In FIG. 9, V1 to V3 represent the positions of the response unit 13*a* at times t1 to t3 and V4 to V6 represent the positions of the response unit 13*b* at times t4 to t6. The symbol A indicates the signal radiation zone (it is assumed that the direction in which the communication zone 11*b* is scanned by the beam-shaped signal is in one direction as indicated by an arrow S in the Figure).

Figures 10A, 10B, 10C:
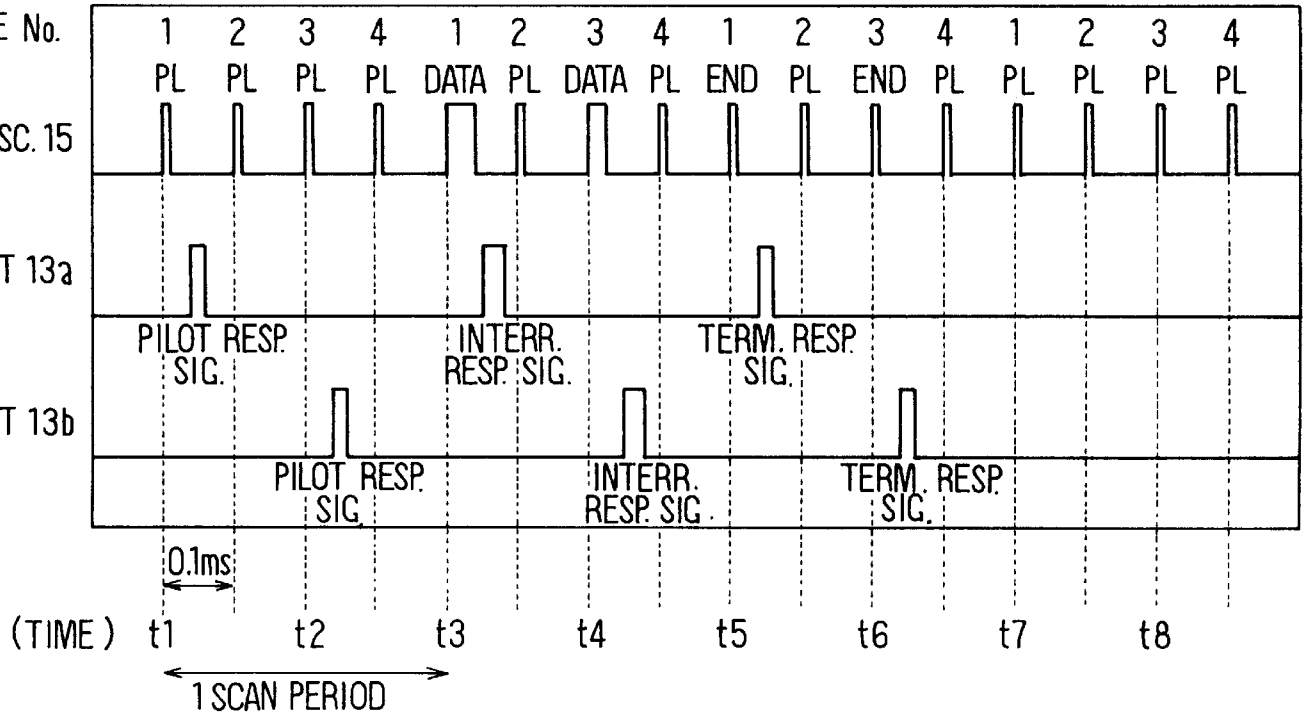
FIGS. 10A–10C are timing charts showing the content of the communication sequence.

FIGS. 10A–10C show transmission/reception sequences between the transceiver 15 and the response units 13*a* and 13*b*. In this case, the intervals at which pilot signals are output from the transceiver 15 are each set to be, for example, 0.1 msec. and the maximum value of the scan angle number is set to be, for example, four, whereby scanning of the beam-shaped signal is performed at a higher speed than in the case of the communication sequence according to the serial processing system described above.

Note that in FIG. 10A, the signals transmitted from the transceiver 15 are expressed as simplified data-type symbols PL (i.e., a pilot signal), data (i.e., an interrogation signal) and END (i.e., a termination signal), and therefore these simplified symbols will also be used in the following explanation.

In this system, the transceiver 15 periodically transmits a pilot signal PL containing a scan angle number. In FIG. 10B, at a time t1, the response unit 13*a* receives a pilot signal PL and, from this response unit 13*a*, a pilot response signal is returned. Upon receiving this pilot response signal, the transceiver 15 extracts an ID code contained in the pilot response signal and stores it based on the scan angle number (e.g., one) corresponding to that point in time. In addition, it processes the ID code and prepares data to be transmitted next with respect to the response unit 13*a* which transmitted the ID code.

At a time t2 thereafter, the response unit 13*b* receives a pilot signal PL and returns a pilot response signal. Upon receiving this pilot response signal, the transceiver 15 extracts an ID code contained in the pilot response signal and stores it based on the scan angle number (e.g., three) corresponding to that point in time. In addition, it processes the ID code and prepares data to be transmitted next with respect to the response unit 13*b* which transmitted the ID code.

Thereafter, when the scan angle number coincides with the scan angle number stored corresponding to the ID code from the response unit 13*a* at time t3, the transceiver 15 transmits an interrogation signal carrying the above-described prepared data, and upon receiving this interrogation signal data, the response unit 13*a* responds with an interrogation response signal. Also, when the scan angle number coincides with the scan angle number stored corresponding to the ID code from the response unit 13*b* at time t4, the transceiver 15 transmits an interrogation signal carrying the above-described prepared data, and upon receiving this interrogation signal data, the response unit 13*b* returns an interrogation response signal.

Upon receiving the above-described interrogation response signals, the transceiver 15 analyzes these signals and determines whether or not data from the response units 13*a* and 13*b* are acceptable and prepares the results as transmission data.

Thereafter, when the scan angle number coincides with the scan angle no. (=1) stored corresponding to the ID code from the response unit 13*a* at time t5, if no problem exists concerning the data from the response unit 13*a*, the transceiver 15 transmits a previously-prepared termination signal END. If there is an error in the data from the response unit 13*a*, the transceiver 15 transmits an error signal. Upon receiving the termination signal END, the response unit 13*a* returns a termination response signal. Upon receiving the termination response signal, the transceiver 15 completes its communications with the response unit 13*a*. On the other hand, upon receiving the error signal, the response unit 13*a* processes the error signal and, according to the content thereof, prepares data to be re-transmitted to the transceiver 15.

Also, when the scan angle number coincides with the scan angle number (=3) stored corresponding to the ID code from the response unit 13*b* at time t6, the same communication operations as described above are performed with that response unit as shown in FIG. 10C.

Figures 11A, 11B, 11C:
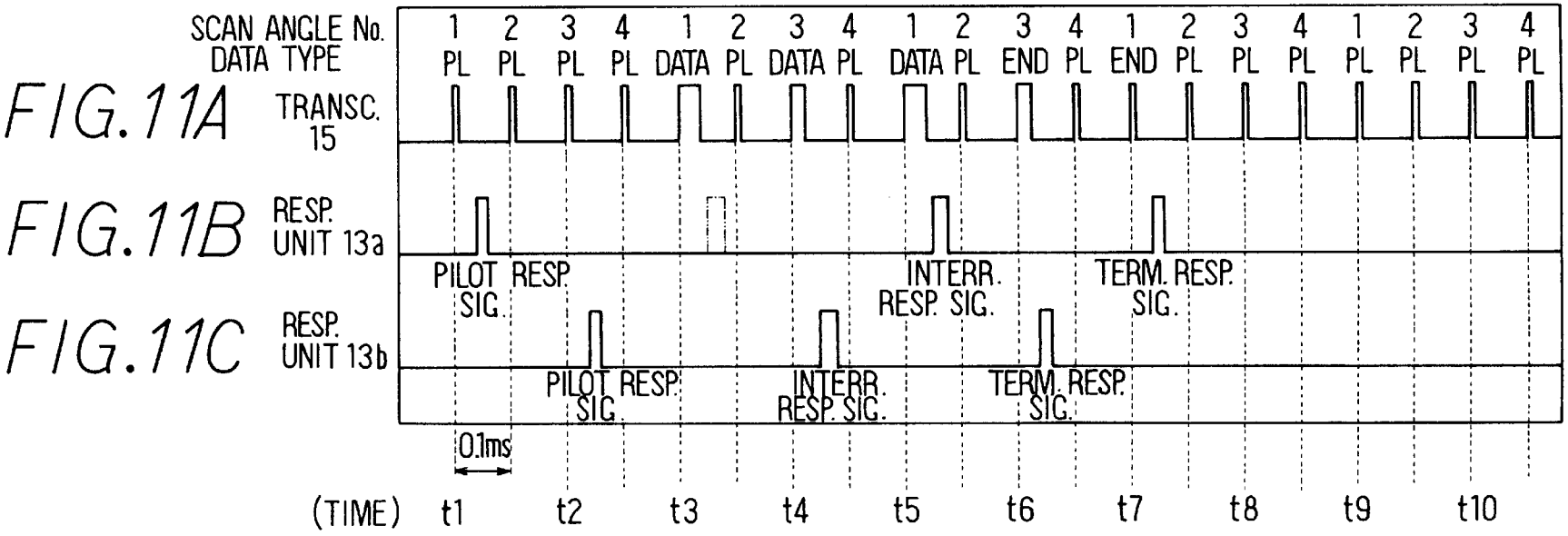
FIGS. 11A–11C are additional timing charts showing the content of the communication sequence.
Figure 13:
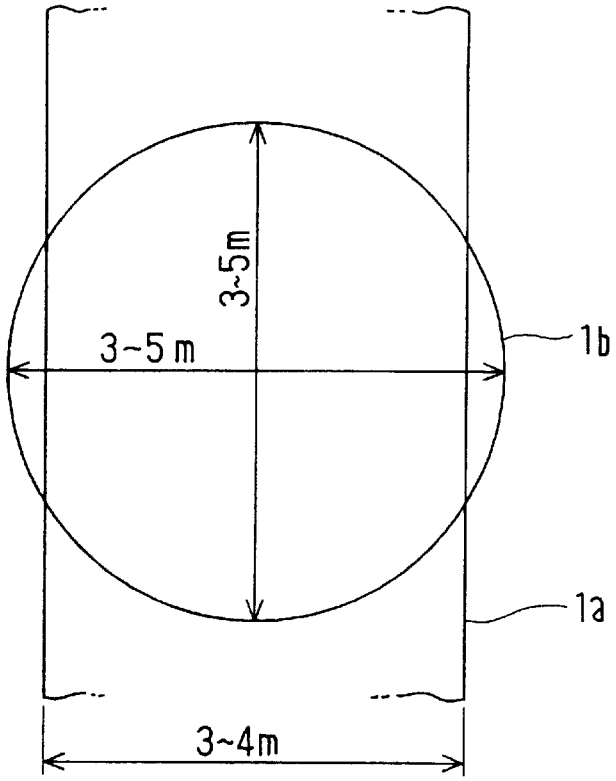
FIG. 13 PRIOR ART
FIG. 13 shows the size of a communication zone according to the prior art.
Figure 14:
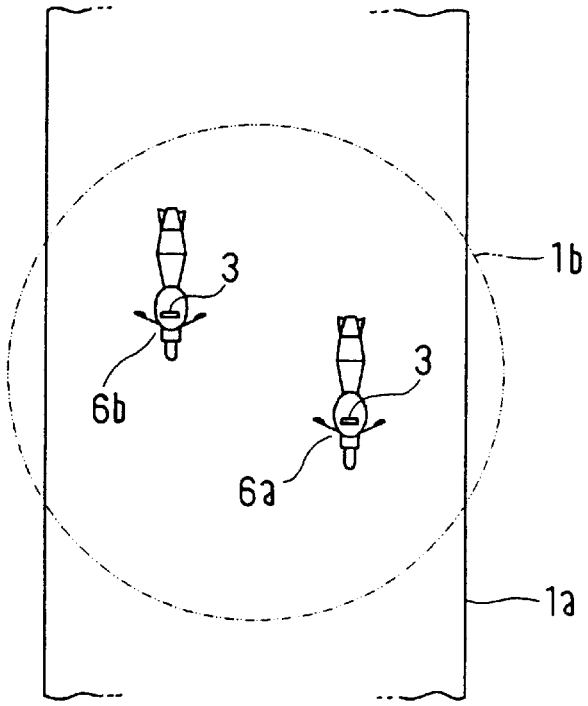
FIG. 14 PRIOR ART
FIG. 14 is an overhead view showing operation of a movable body communication system according to the prior art.

In this case, when the transceiver 15 has failed to receive reply signals from one of the response units 13*a* and 13*b* at the above-described timings, the transceiver 15 performs a signal re-transmission operation with respect to the response unit 13*a* or 13*b* at a timing when the scan angle number again coincides with the scan angle number stored corresponding to the ID code from the response unit 13*a* or 13*b*. An example of this feature is shown in FIGS. 11A–11C. In FIG. 11A, when an interrogation response signal responsive to the interrogation signal data which was transmitted at, for example, a time t3 (i.e., when the scan angle number is one) has not been returned as shown in FIGS. 10B and 10C, an interrogation signal is re-transmitted at a time t5 when the scan angle number again is one.

As a result, the vehicle at a scan position where a signal has been returned can be easily recognized using the scan angle number corresponding to an actual scan position of a signal in the communication zone 11*b*. Therefore, even when two or more vehicles 12*a*, 12*b* enter the same communication zone 11*b* in tandem, it is possible to reliably determine the positions of the response units 13*a* and 13*b* and consequently the positions of the vehicles 12*a* and 12*b*.

Accordingly, when, for example, two vehicles have entered the same communication zone 11*b*, even if one of them has no response unit 13 located thereon, by using this invention, it is possible to reliably detect a vehicle which does have a response unit 13 and to avoid confusing it with another vehicle which does not have such a unit.

Further, in this embodiment, the scan areas of the signals radiated from the transmission antennas 21 of the plurality of transceivers 15 corresponding to the plurality of lanes 11*a* are scanned with the scan patterns being synchronized with each other so that the scan areas of the signals radiated from adjacent transmission antennas 21 do not overlap. For this reason, the distance between the zones with respect to which signals are radiated with the same timing from adjacent transceivers 15 can at all times be maintained to be a fixed value or to be greater than a certain value (i.e., to include a safety margin), so that the possibility that radiated signals interfere with each other is small. Thus, it is not necessary to perform time-division multiplex communications between adjacent transceivers 15 or to use different frequency bands in adjacent transceivers, as in the prior art. Consequently, the communication performance of the system can be enhanced, and it is not necessary to use multiple antennas having different resonance frequencies; thus, the overall system structure can be simplified.

Also, since the transceiver 15 generates a beam-shaped signal consisting of millimetric waves which is radiated through the transmission antenna 21, the following advantages are provided. First, since millimetric waves have high directivity, it is possible to easily restrict the radiation area of the beam-shaped signal and thereby make the electronic scan area as small as possible. As a result, the possibility that two or more response units 13 are simultaneously present in the same scan area is extremely small, and radio interference when multiple vehicles are in the same communication zone 11*b* can be effectively suppressed.

Also, when using millimetric waves to perform communications between the transceiver 15 and response unit 13, it is possible to great1y increase the data transmission capacity up to 10 Mbps or more from several hundreds of kbps when using a signal in a microwave band or quasi-microwave band. This enables shortening of the required communication time period. Also, as a result, it is possible to shorten the length of the communication zone 11*b* as viewed in the forward travel direction of the vehicle, i.e., the size of the communication zone.

The present invention is not limited to the above-described embodiment but may be modified in ways readily apparent to those of ordinary skill in the art. For example, although in the above-described embodiment, the array antenna constituted by the patch antennas has been used as the transmission antenna, other types of array antennas may be used; additionally, horn antennas, parabolic antennas or the like may also be used.

Further, although in the above-described embodiment, scanning of a signal radiated from the transmission antenna is done electronically, it is possible to perform mechanical scanning by using, e.g., a polygonal reflector, a parabolic antenna where the emissive surface thereof is appropriately varied, a construction wherein a plurality of arranged antennas are sequentially operated, or the like, as will be readily apparent to those of ordinary skill in the art.

Also, although in the above-described embodiment, a signal in the millimetric wave band is transmitted from the transmission antenna, a signal in the microwave band or in quasi-microwave band may be used instead. Moreover, although in the above-described embodiment a pilot signal is transmitted, it is possible that the function of the pilot signal is incorporated into the interrogation signal.

Additionally, although in the above-described embodiment the invention has been in an automatic toll collection system for use in a road, it is not limited thereto; for example, the present invention can be also in an operation control system for driverless carrier vehicles within a factory or the like, a physical distribution management system, or an automatic toll collection system for ski lifts or amusement parks and the like.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A movable body communication system having at least one transceiver, disposed with respect to at least one movement path of a movable body, for transmitting a transmit signal to said movable body and receiving a response signal transmitted from said movable body responsive to said transmit signal to thereby perform data transmission/reception with said movable body within a time period during a single scan of a communication zone, said transmit signal being transmitted in a beam-shaped pattern having a cross-sectional radiation area smaller than the area of the communication zone, said at least one transceiver comprising:

an antenna for performing transmission of said transmit signal and reception of said response signal; and scanning means for scanning said transmit signal transmitted from said antenna in a direction orthogonal to said at least one movement path of said movable body through a plurality of movement path portions, and for specifying said movable body for data exchange between said transceiver and said movable body in an identified one of said plurality of movement path portions, identification of said movable body and said data exchange occurring while said movable body is within the same communication zone.

2. A movable communication system as set forth in claim 1, wherein:

said at least one transceiver includes a plurality of transceivers each having an antenna for performing transmission of said transmit signal and reception of said response signal, and scanning means for scanning said transmit signal transmitted from said antenna in a direction orthogonal to said at least one movement path of said movable body;

said at least one movement path includes a plurality of vehicle movement paths parallel to one another;

said plurality of transceivers are disposed in correspondence with said plurality of vehicle movement paths; and each of said scanning means in said plurality of transceivers scans its respective signal in a predetermined pattern, said predetermined pattern of ones of said scanning means in said transceivers corresponding to adjacent travel paths being synchronized so that the communication zone of transmit signals radiated from transmission antennas in transceivers corresponding to adjacent travel paths do not overlap.

3. A movable body communication system as set forth in claim 1, wherein said at least one transceiver is for radiating a beam-shaped signal of millimetric waves from said transmission antenna.

4. A movable body communication system as set forth in claim 1, wherein said at least one transceiver is for performing communications with a plurality of movable bodies in a communication zone so that until communications with a response unit of a first movable body in said communication zone with which it has started to communicate initially are completed, communications with a response unit of another movable body in said communication zone are not performed.

5. A movable body communication system as set forth in claim 1, wherein said at least one transceiver is for performing communications with a plurality of movable bodies in a communication zone so that communication operations with said plurality of said movable bodies in said communication zone are performed alternately on step-by-step basis.

6. A movable body communication system as set forth in claim 1, wherein said antenna is an array antenna including patch antennas.

7. A movable body communication system as set forth in claim 1, wherein said movable body is equipped with a response unit for transmitting a response signal to said at least one transceiver and receiving a transmit signal therefrom.

8. A movable body communication system as set forth in claim 7, wherein said transceiver is for transmitting a pilot signal to wake up said response unit.

9. A movable body communication system as set forth in claim 8, wherein said transceiver is further for transmitting a first unmodulated carrier signal after transmitting said pilot signal.

10. A movable body communication system as set forth in claim 9, wherein said response unit is for waking up when it receives said pilot signal.

11. A movable body communication system as set forth in claim 10, wherein said response unit is for modulating said first unmodulated carrier signal to obtain a modulated carrier signal and for transmitting said modulated carrier signal as a pilot response signal to said at least one transceiver.

12. A movable body communication system as set forth in claim 11, wherein said transceiver is for transmitting an interrogation signal to said response unit responsive to receipt of said pilot response signal.

13. A movable body communication system as set forth in claim 12, wherein said transceiver is for transmitting a second unmodulated carrier signal after it has transmitted said interrogation signal.

14. A movable body communication system as set forth in claim 13, wherein said response unit is for modulating said second unmodulated carrier signal to obtain a second modulated carrier signal when it has received said interrogation signal and for transmitting said second modulated carrier signal as an interrogation response signal to said transceiver.

15. A movable body communication system as set forth in claim 1, which is applied to an automatic toll collection system for a road.

16. A movable body communication system as set forth in claim 1, wherein said transmit signal transmitted from said antenna has a radiation width which is less than a movable body lane width.

17. A method of communicating comprising the steps of:

radiating a first communication signal from a first fixed station to a first portion in a plurality of portions of a first communication zone located in a path of travel of a mobile station, said first communication signal being radiated in a beam-shaped pattern having a cross sectional radiation area smaller than an area of the first communication zone;

moving an area of radiation of said first communication signal to a second portion, different from said first portion, in said plurality of portions of said first communication zone;

receiving said communication signal with said mobile station when said mobile station is within one of said plurality of portions radiated by said first communication signal; and transmitting a communication response signal responsive to said first communication signal from said mobile station to said first fixed station in said one of said plurality of portions radiated by said first communication signal, wherein said radiating, moving receiving and transmitting steps cause said mobile station to be identified and data to be exchanged and said identification of said mobile station and said exchange of date occur within a time period during a single scan of said first communication zone while said movable station is within the said first communication zone.

18. The method of claim 17, wherein said plurality of portions collectively define said first communication zone.

19. The method of claim 17, wherein said moving step is performed in a direction orthogonal to said path of travel of said mobile station.

20. The method of claim 17, wherein said first communication signal is a pilot signal and said communication response signal is a pilot response signal.

21. The method of claim 20, further comprising the steps of:

radiating an interrogation signal from said first fixed station to one of said plurality of portions;

moving an area of radiation of said interrogation signal to a different one of said plurality of portions;

receiving said interrogation signal with said mobile station when said mobile station is within one of said plurality of portions radiated by said interrogation signal; and transmitting an interrogation response signal responsive to said interrogation signal from said mobile station to said first fixed station;

receiving said interrogation response signal at said first fixed station.

22. The method of claim 21, further comprising the step of prohibiting communication between said first fixed station and other mobile stations during a time period between receipt of said pilot response signal by said first fixed station and receipt of said interrogation response signal by said first fixed station.

23. The method of claim 21, further comprising the step of performing communication between said first fixed station and at least one other mobile station during a time period between receipt of said pilot response signal by said first fixed station and receipt of said interrogation response signal by said first fixed station.

24. The method of claim 17, wherein said first communication signal is an interrogation signal and said response signal is an interrogation response signal.

25. The method of claim 17, further comprising the steps of:

radiating a second communication signal from a second fixed station to a first portion in a plurality of portions of a second communication zone located in a path of travel of a mobile station; and moving an area of radiation of said second communication signal to a second portion, different from said first portion, in said plurality of portions of said second communication zone in synchronization with movement of said first communication signal so that an area of radiation of said first communication signal and an area of radiation of said second communication zone do not overlap.

26. The method of claim 17, wherein said moving step comprises scanning in a mobile station lane width direction.

27. A communication system including at least one transceiver that transmits a transceiver signal to a moving vehicle, and that receives a response signal from the moving vehicle that is responsive to the transceiver signal for data transmission/reception purposes within a time period during a single scan of a communication zone, said transceiver signal being transmitted in a beam-shaped pattern having a cross-sectional radiation area smaller than the area of the communication zone, the at least one transceiver comprising:

an antenna that transmits the transceiver signal, and that receives the response signal; and a scanner that scans the transceiver signal transmitted from the antenna in a vehicle lane width direction through a plurality of vehicle lane width portions to specify said moving vehicle in one of said vehicle lane width portions for data exchange between said transceiver and said moving vehicle in said identified one of said plurality of vehicle lane width portions, identification of said moving vehicle and said data exchange occurring while said moving vehicle is within the same communication zone.

* * * * *